United States Patent [19]

Beck

[11] 4,367,123

[45] Jan. 4, 1983

[54] PRECISION SPOT PLATING PROCESS AND APPARATUS

[75] Inventor: Alexander F. Beck, Hamden, Conn.

[73] Assignee: Olin Corporation, New Haven, Conn.

[21] Appl. No.: 313,848

[22] Filed: Oct. 22, 1981

Related U.S. Application Data

[63] Continuation of Ser. No. 167,077, Jul. 9, 1980.

[51] Int. Cl.[3] ..... C25D 5/08; C25D 17/00

[52] U.S. Cl. ..... 204/15; 204/224 R

[58] Field of Search ..... 204/15, 16, 129.6, 224 R

[56] References Cited

U.S. PATENT DOCUMENTS

| | | | |
|---|---|---|---|
| 2,750,332 | 3/1956 | Miller | 204/15 |
| 3,468,785 | 9/1969 | Polichette | 204/224 R |
| 3,810,829 | 5/1974 | Fletcher | 204/222 |
| 3,894,918 | 7/1975 | Corby et al. | 204/15 |
| 3,957,614 | 5/1976 | Corby et al. | 204/224 R |

FOREIGN PATENT DOCUMENTS

| | | | |
|---|---|---|---|
| 1147730 | 11/1957 | France | 204/224 R |
| 2203891 | 5/1974 | France | 204/224 R |
| 3087 | of 1904 | United Kingdom | 204/224 R |
| 775359 | 5/1957 | United Kingdom | 204/224 R |
| 1556226 | 11/1979 | United Kingdom | 204/15 |

*Primary Examiner*—T. Tufariello

*Attorney, Agent, or Firm*—Barry L. Kelmachter; Howard M. Cohn; Paul Weinstein

[57] ABSTRACT

A process and apparatus for electroplating a spot of metal on a substrate and optionally a plurality of such spots in a desired arrangement. A column of electrolyte having a transverse cross-sectional shape corresponding about to the shape of the desired spot of metal to be plated is formed between an anode and the substrate which is connected as a cathode. The electrolyte is supplied by force of gravity with a desired hydrostatic head pressure. The substrate can be sequentially advanced to electrodeposit spots of metal at different points on the substrate.

16 Claims, 5 Drawing Figures

PRECISION SPOT PLATING PROCESS AND APPARATUS

This application is a continuation, of application Ser. No. 167,077, filed July 9, 1980.

The present invention relates to a process and apparatus for spot electroplating and more particularly a process and apparatus for preferably electroplating gold layers on the contact portions of lead frames used in semiconductor devices.

In the manufacture of certain integrated circuites, leads from an integrated circuit chip are bonded individually to gold conductive patterns formed on an insulating ceramic substrate. In order to interconnect and power such integrated circuits, leads are connected to the conductive pattern. These leads often comprise a lead frame stamped from a sheet of conductive metal such as nickel, copper or the like. The lead frame has a group of leads for each conductive pattern of each substrate, and these leads or arms are bonded to the conductive pattern on the substrate. The outer ends of the lead frame arms are connected to carrier strips and their opposed inner free ends are bonded to the conductive pattern on the substrate. The arms may also be interconnected intermediate their ends by relatively narrow support strips.

In the prior art techniques, a layer of gold has often been formed over the entire lead frame including the arms and the carrier and support strips by electroless plating or electroplating. The purpose of such a gold layer is to improve the bonding to the lead frame. In other prior art techniques, a nonuniform layer of gold has been formed over the entire lead frame with the greatest thickness being concentrated at those portions of the frame, namely the arms where the bonding of an integrated circuit chip or other semiconductive device is to take place.

Since the carrier and support strips are ultimately trimmed away it is desirable to have no gold on them. Since the substrates are bonded to the inner free ends of the lead frame arms it is desirable to have a gold layer only thereon to improve bonding. The absence of gold on the carrier and support strips and everywhere else except where bonding is to take place eliminates expensive gold use and the time-consuming reclamation processes to recover the gold.

Two known methods and apparatus for selectively plating lead frames or the like are disclosed in U.S. Pat. Nos. 3,894,918 and 3,468,785. The U.S. Pat. No. 3,894,918 discloses a method and apparatus utilizing a relatively large bath of electrolyte which is confined to a selected area by seal means. While the method and apparatus described overcomes the problem of plating the entire lead frame as is the case in tank dipping methods, portions of the lead frame where substrate bonding is not to take place are still plated. U.S. Pat. No. 3,468,785 likewise deposits from a relatively large bath of electrolyte which is confined by means of seals. The use of seals in both of the abovenoted U.S. Patents increases the complexity and cost of practicing both processes. In addition, both processes plate relatively large areas including areas where substrate bonding is not to take place.

U.S. Pat. No. 3,810,829 discloses a method and apparatus for electrolytically forming a fine lined pattern on a stationary substrate by means of a moving nozzle assembly without the need for masking, seals or the like.

Attempts have been made to avoid the deficiencies of the above patents by eliminating the masking of the substrate which is to be plated. One such approach is described in British Pat. No. 1,556,226 to Bestel et al. In the Bestel et al. arrangement, selective spot plating of the substrate without directly masking the substrate is provided by means of a plating head which contains at least one anode and a dielectric member which contact-masks the anode so that only selected areas of the substrate are plated.

In U.S. Pat. No. 3,810,829 to Fletcher, a plating system is disclosed which includes a nozzle assembly which is movable relative to the substrate to be plated at a selected rate and movement pattern. The resolution of the plated pattern is a function of the nozzle opening dimension, the distance from the nozzle to the substrate and the pressure applied to the stream, which is relatively high, for example, 500 to 700 psi.

In accordance with the present invention, a low pressure spot plating system has been developed which does not require substrate masking and which is relatively simpler in construction than the prior art approaches noted above.

Clearly, it is of considerable advantage and highly desirable to selectively spot plate a metal substrate and in particular the contact portions of lead frame arms without incurring the high costs associated with known techniques. Likewise, it is also highly desirable to selectively spot plate a metal substrate as the substrates are advanced in a semicontinuous manner.

Accordingly, it is the principal object of the present invention to provide a process and apparatus for selectively spot plating a metal substrate without substrate masking.

It is a particular object of the present invention to selectively spot plate lead frames solely in those areas where bonding of wires, etc., is to take place.

It is a further object of the present invention to spot plate a metal substrate in a semicontinuous manner.

It is a still further object of the present invention to provide an apparatus for carrying out the present invention which is relatively inexpensive when compared to known apparatus.

Further objects and advantages of the present invention will appear hereinbelow.

In accordance with the present invention, it has been found that the foregoing objects and advantages may be readily obtained by providing a highly efficient and economical process and apparatus for selectively spot plating a metal substrate without substrate masking and more particularly selectively spot plating contacts on lead frames in only those areas where bonding of wires, etc., is to take place.

In accordance with the process of the present invention, a metal substrate or lead frame is fed to a plating station where it is supported and positioned under preferably a stationary assembly including at least one jet forming tubular member having a nozzle substrate opening of predetermined size arranged at a preferred distance from the outlet. At the plating station the substrate is electrically connected preferably as a cathodic element. An electrolytic stream flows over an anode element which may be the tubular member and continually flows from the jet forming nozzle over the substrate under the force of a hydrostatic head pressure provided by an electrolyte reservoir which is in fluid communication with the nozzle. A predetermined voltage is applied between the anode and cathode so as to selectively spot plate the substrate with a spot which is approximately the same size as the opening of the nozzles outlet.

The apparatus for carrying out the process of the present invention comprises at least one jet forming nozzle defining an opening of desired size through which the electrolyte stream is delivered under a predetermined low pressure to the substrate so that the configuration of the plated spot is substantially the same as that of the nozzle opening. The pressure at which the stream is delivered is hydrostatically controlled by controlling the height of the electrolyte over the substrate to be plated. The resolution and dimension of the plated spot is a function of the jet forming nozzle opening, the distance from the nozzle to the substrate and the pressure applied to the electrolytic stream.

In accordance with another embodiment of the present invention, a plurality of jet forming nozzles of controlled size and spacing in an assembly are arranged to spot plate a plurality of contacts on a lead frame in a single operation. The lead frames may be selectively plated at high speed by being advanced in a contiguous step-wise manner under the nozzle assembly.

The present invention provides significant advantages over plating systems heretofore known. For example, by employing the process and apparatus of the present invention selective spot plating is accomplished without the necessity of maskings, seals or the like and at a fraction of the cost incurred by known processes.

These and other objects will become more apparent from the following description and drawings.

FIG. 3A illustrates a plating stream produced by the process and apparatus of the present invention and where FIG. 3B illustrates an undesired plating stream.

In accordance with the present invention a metal substrate and more particularly a lead frame is selectively spot plated. The present invention will be described and exemplified with reference to selective spot electroplating of contacts on lead frames. However, it should be appreciated that much broader applications can be made within the scope of the present invention.

Figure 1:
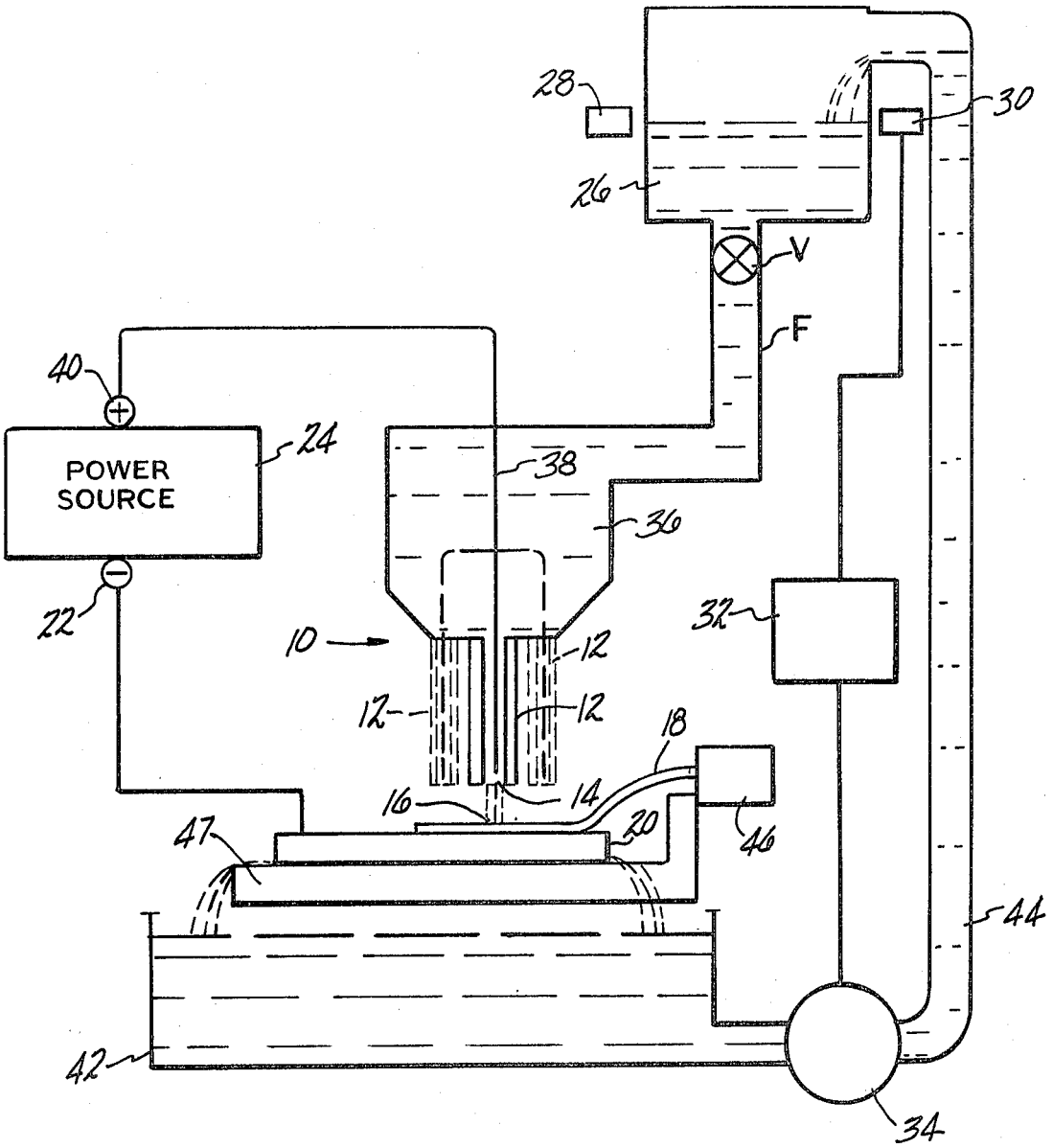
FIG. 1 is a schematic illustration showing a first embodiment of the apparatus of the present invention.

Referring to FIG. 1, an electrodepositing system for carrying out the process of the present invention is illustrated. The system comprises a plating head assembly 10 provided with at least one tubular member 12 having a jet forming nozzle opening outlet 14 of a desired size. As will be discussed in detail hereinbelow, the size of the plated spot of metal is a function of the nozzle outlet opening size 14, the distance of the nozzle outlet opening 14 from the substrate 20 and the pressure applied to the electrolyte stream 16. It should be appreciated that a plurality of jet forming nozzles 12 as shown in phantom of controlled size and spacing from each other may be provided in the head 10 for selectively spot plating a plurality of spots on a substrate 20 in a single operation. However, for purposes of illustration, the process and apparatus of the present invention will be described with reference to a single jet forming nozzle 12.

Referring again to FIG. 1, a substrate 20 is positioned beneath the nozzle opening outlet 14 at a desired distance therefrom. The substrate 20 when in position is connected to the negative terminal 22 of a power source 24 and, therefore, becomes a cathodic element. An electrolyte reservoir 26 is provided at a desired distance above the substrate 20 so as to deliver the electrolyte from the nozzle opening outlet 14 at a desired applied hydrostatic pressure.

In accordance with the present invention, the pressure applied to the electrolyte stream 16 is controlled by regulating the electrolyte hydrostatic head pressure determined by the height of the electrolyte in the reservoir 26. This may be accomplished by using a transparent container 26 and sensing as by a light source 28 and photodetector 30 the height of the electrolyte in the container. The output of the photodetector 30 is coupled to a controller 32 which turns on and off electrolyte pump 34 as required to maintain the desired height of the electrolyte in accordance with the position of the detector 30. The electrolyte height providing the hydrostatic head or pressure can be varied by moving the light 28 and detector 30 up or down as desired. In this manner, the applied pressure is controlled in a simple, economical, and efficient manner.

The reservoir 26 is charged with the electrolyte and upon the opening of the non-throttling valve V the electrolyte is allowed to flow under the force of gravity from the reservoir 26 to a manifold 36 in head assembly 10 via feed line F. The electrolyte in the manifold 36 continuously flows over an anode 38 which is connected to the positive terminal 40 of power source 24. It then flows through tubular member 12 and over the substrate 20 and wire 18 and into a catch basin 42. The electrolyte is recycled to the reservoir 26 by means of the pump 34 via line 44.

Depending on the electrolyte composition, the anode 38 may be consumable or passive as desired. In the case of electrodepositing a gold spot, a consumable anode 38 is not required. In such a case the system may be simplified by eliminating the anode 38 and connecting an electrically conductive tubular element 12', preferably stainless steel so that it becomes the anode as in FIG. 2.

Figure 2:
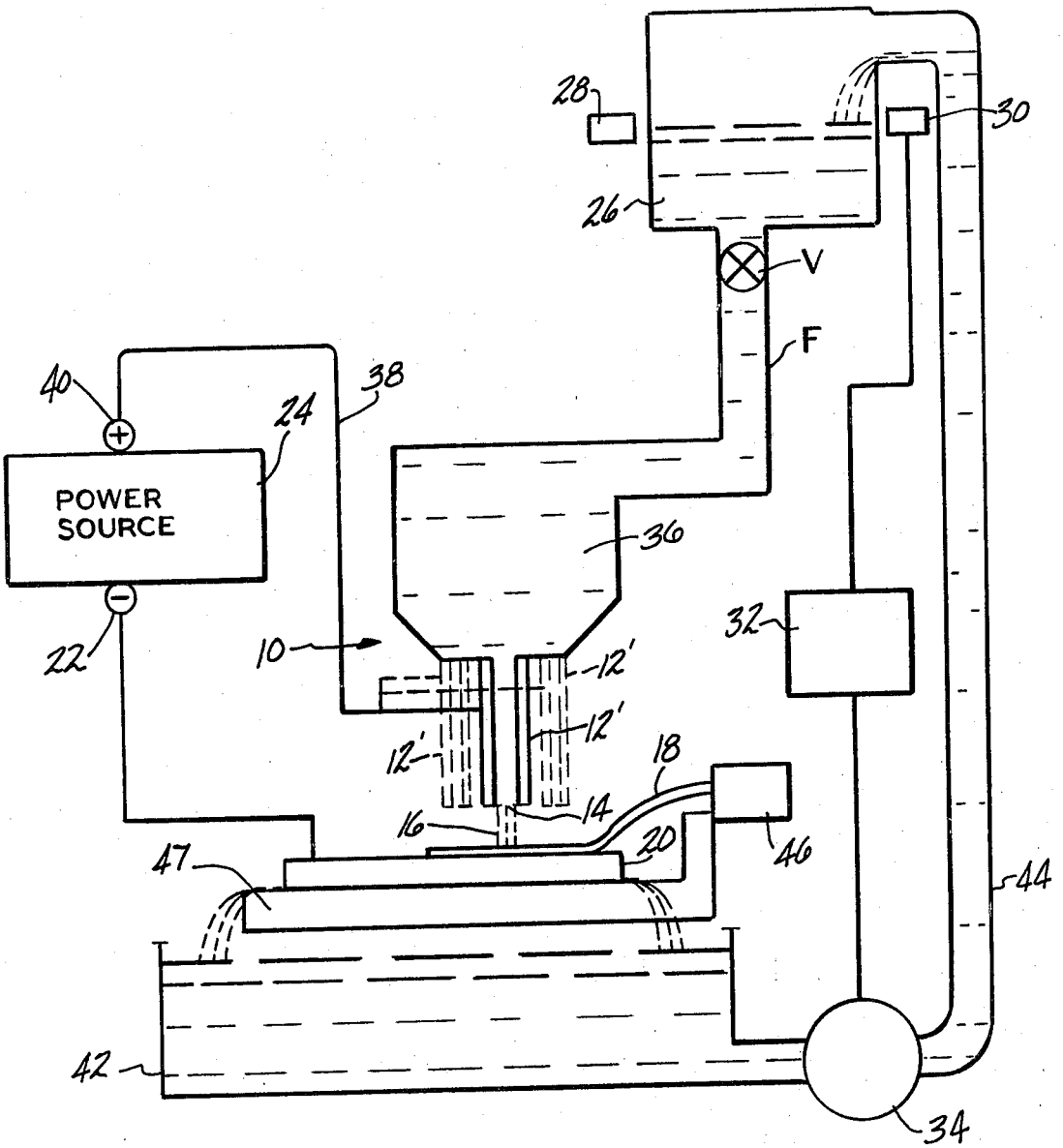
FIG. 2 is a schematic illustration showing an alternative embodiment of this invention.

In FIG. 2 like elements have the same reference numerals as the corresponding elements in FIG. 1 and function in exactly the same manner as described by reference to FIG. 1. The only difference between the embodiments of FIGS. 1 and 2 is that the embodiment of FIG. 2 is intended for use with a non-consumable anode whereby the tubular member 12' can act as the anode. It is significant with respect to both embodiments that it is not necessary in accordance with this invention to mask the anode in any respect.

With the systems as described above, plating by the constant flow of electrolyte only occurs when a minimum potential voltage difference is applied between the substrate 20 and the electrolyte in contact with the anode 38.

In operation, the electrolyte reservoir 26 is charged with electrolyte, and valve V is opened so as to allow the electrolyte to flow under the force of gravity to the manifold 36 over the anode 38 through tubular member 12 or 12' and out jet forming nozzle opening 14 onto the substrate 20 and into the sump 42 from which the electrolyte is recirculated to the reservoir 26 by the pump 34 as required to maintain the desired electrolyte level. Thus, the electrolyte continuously flows until the valve V in line F is closed. The workpiece or substrate 20 is brought into proximity with the head assembly 10 and connected to terminal 22 so that the flowing electrolyte contacts the substrate 20. Current is then applied to anode 38 or 12' and cathode 20 for a small amount of time so as to selectively electrodeposit a spot of metal such as gold over a desired portion of the substrate 20.

The substrate 20 should be electrically conductive or be coated with an electrically conductive material. The substrate surface material may include gold or silver either pure or alloyed or other desired metal or alloy. Likewise, the electroplated metal spot may be gold, copper, nickel, silver, or their alloys as well as other suitable electroconductive materials which may be electrodeposited.

Figure 3A:
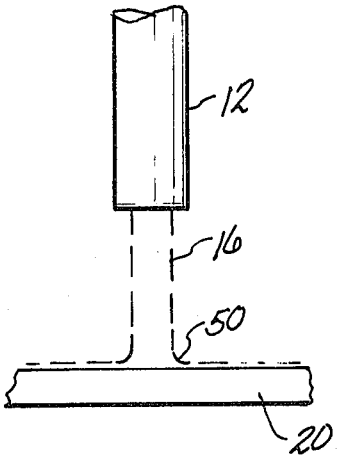
FIGS. 3A and 3B illustrate the configuration of an electrolytic stream produced where

As noted above, the resolution and size of the plated spot is a function of the nozzle opening size 14, the distance of the nozzle opening 14 from the substrate 20, and the pressure applied to the electrolyte. To obtain such a selective spot plating of a desired limited area, i.e., an area substantially equal to the dimension of the jet forming nozzle opening 14, it is necessary to control and maintain the shape of the electrolyte stream 16 as it travels from the nozzle 12 or 12' to the substrate 20. It is necessary to maintain the electrolyte stream 16 so that there is little fanning out of the electrolyte before impinging on the surface of the substrate 20 and so that the flowing film 50 of electrolyte on the substrate 20 is thin except in the region of the stream 16 as in FIG. 3A.

Figure 3B:
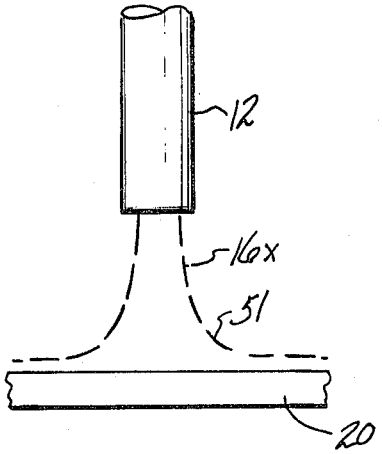

In order for plating to take place, it is necessary to have a minimum potential voltage, above 5 volts and preferably less than 50 volts, across the anode 38 and cathode 20. If the electrolyte column or stream 16 is maintained in the same shape as the nozzle outlet opening 14, the voltage and current in the thin flowing film 50 area is nil due to high electrical resistance. However, if the electrolyte column 16X is not maintained but allowed to coarsely fan out as in FIG. 3B, the resistance in the fanned out portion 51 is not particularly high and, therefore, the voltage not so low as to prohibit plating. Thus, when the electrolyte stream 16 is not maintained as a well-defined column 16X, an area substantially larger than the nozzle opening 14 would be plated. When the stream 16 is maintained as a well-defined column substantially to the substrate 20, then the area plated corresponds to that of the nozzle opening.

The electrolyte stream 16 is maintained by controlling the nozzle opening 14 dimension, the pressure applied to the electrolyte and the nozzle to substrate spacing. In accordance with the present invention, the nozzle opening 14 major dimension, such as diameter, is chosen so that it is effectively equal to the desired spot size to be plated.

Preferably the nozzle opening major dimension comprises about 0.25 mm to 5 mm, most preferably 0.5 mm to 1.5 mm and ideally about 1.0 mm.

The nozzle opening 14 is placed as close to the substrate 20 as possible in order to limit the travel distance of the electrolyte stream 16 thereby reducing the electrical resistance of the stream and correspondingly the energy required to effect plating. By shortening the distance the stream 15 travels, it is easier to limit the fanning out of the electrolyte column. Naturally, a minimum distance between the nozzle opening 14 and substrate 20 must be maintained in order to avoid an electrical shorting effect and eliminate splashing of the electrolyte on the substrate 20 which would result in the same effect as the fanned out column discussed above in reference to FIG. 3B. A distance of about 5 to 10 mm has been found effective for most bonding applications.

The pressure applied to the electrolytic stream 16 is a function of the nozzle opening 14 dimension. It is necessary that the electrolyte flow from the nozzle opening 14 at a rate sufficient to maintain a substantially uniform electrolyte column. It has been found that a flow rate of about 0.5 mls per second to 1.0 mls per second is sufficient for most applications. Ideally, 0.7 mls per second is employed. The required flow rate is accomplished by applying a pressure of from about 1 to 3 psi for the desired nozzle openings 14 set forth above.

As noted above, a minimum voltage of about 5 volts is required to effect a spot plating under the parameters of nozzle opening 14 dimension, nozzle to substrate 20 spacing and electrolyte flow rate. Ideally, the voltage is under 50 volts to avoid undesirable heat buildup and energy losses. A 20 volt potential has been found most desirable. The thickness of the spot plate is a function of current and time. A current of 3 amps/cm$^2$ has been found most suitable for a time of one second for a one micron thick deposit. The thickness of the deposit varies approximately linearly with time.

EXAMPLE I

A spot deposit of gold on a nickel substrate 20 was provided as follows. The nickel was etched in dilute $HNO_2$ for cleanliness and was not given a normal gold strike pretreatment. The electrolyte was the commercially available Englehardt Industries' E-70 composition. The nozzle/anode 12' had a 1 mm inside diameter and comprised a stainless steel tube through which the electrolyte was directed to the nickel cathode at a flow rate of about 0.7 mls per second under a hydrostatic pressure of 2 psi. The anode-cathode (substrate 20) separation was 7 mm. The spot plate was formed by passing a current of about 0.03 amperes at 20 volts for 10 seconds. The overall bulk thickness of the deposit was about 70 microns, and the diameter of the deposit was about 0.85 mm, effectively the same size as the nozzle outlet opening.

EXAMPLE II

On an etched nickel cathode (substrate 20), not having a gold strike, a deposit of gold was electroplated under the same conditions as set forth in Example I, with the exception that a current of less than 0.03 amperes at 15 volts was passed for 2 seconds. The topography of the deposited spot was found to be identical with that of the original etched surface. The electroplated spot thickness was estimated at more than 2 microns (80 microinches).

EXAMPLE III

On an etched nickel cathode (substrate 20), also not having a gold strike, a deposit of gold was electroplated under the same conditions as set forth in Example I, except that a current of about 0.03 amperes was passed at 20 volts for 6 seconds. The topography of the deposited spots was not replicate, as in Example II, but had a dendritic or columnar type structure. The overall thickness was about 50 microns.

Figure 4:
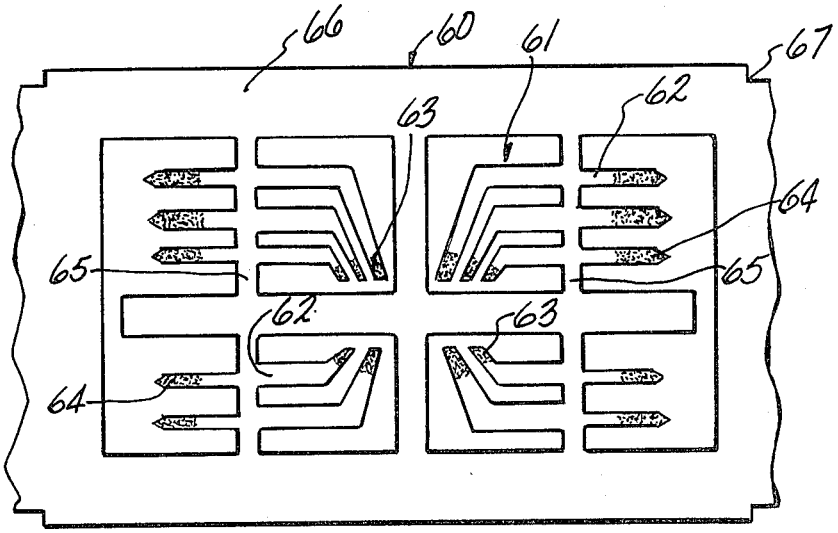
FIG. 4 is a reproduction illustrating the selective spot plating of a lead frame by the process and apparatus of the present invention.

Referring now to FIG. 4, a typical section of the lead frame strip 60 of a desired configuration is shown. The portion of the lead frame strip 60 which is shown includes one complete lead frame 61 for an integrated circuit package. The lead frame 61 is made up of a plurality of leads 62 each having first free end 63 which is adapted to connect to the integrated circuit (not shown) and a second free end 64 which is adapted for insertion into a printed circuit board (not shown). The leads 62 are held in place by support strips 65 which in turn are supported by carrier strips 66. The support strips 65 in the final package are severed between the leads 62 so that the leads are electrically isolated one from the other. It is desired in order to reduce precious metal use that only the contact portions 63 and 64 or ends of the leads be electroplated with, for example, gold. For an arrangement as shown in FIG. 4 this can be accomplished by providing a plurality of nozzle openings 14 and nozzles 12 or 12' each arranged to plate one of the contact areas 63 or 64 of the leads 62. For the lead frame shown in FIG. 4 this would involve a plating head 10 having 20 nozzles 12 or 12'. The spacing of the nozzles 12 or 12' would be in correspondence to the contact areas 63 or 64 on the leads 62 of the lead frame 61 which are to be plated.

EXAMPLE IV

A lead frame 61 similar to that described by reference to FIG. 4 was spot plated by a plating head 10 in accordance with this invention having 20 nozzles 12' arranged and spaced to plate only the contact areas 63 or 64 of the lead frame. The configuration of the individual nozzles 12 and the electroplating conditions were the same as set forth in Example II. As shown in FIG. 4, the spot plating process of this invention resulted in a deposit of a gold plate only on the tips 63 or 64 of the leads 62 thereby eliminating any unnecessary gold plating.

Figure 5:
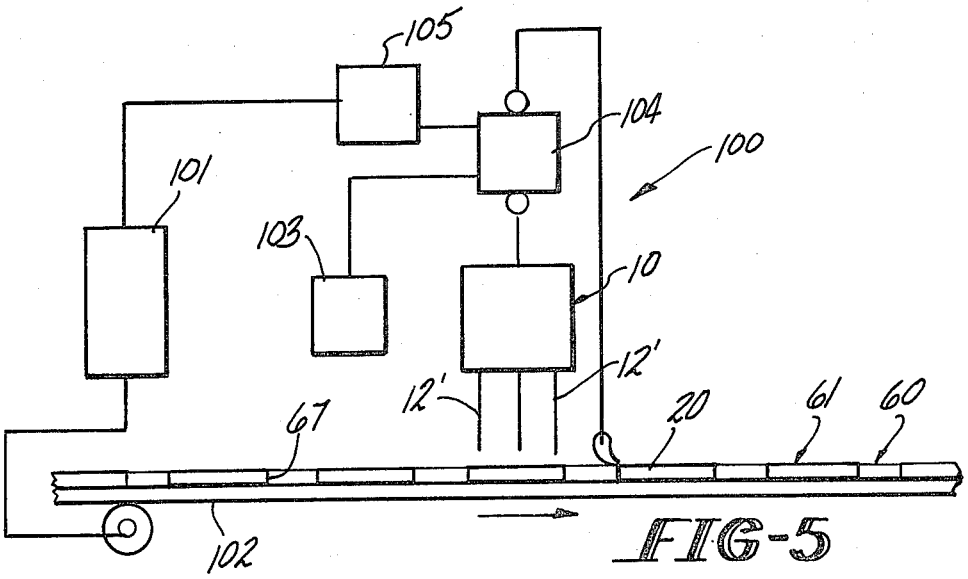
FIG. 5 is a schematic illustration showing a production line employing the plating process and apparatus of the present invention.

The operation of the process of the present invention, as applied to automatic selective spot plating of lead frames, will be discussed with reference to FIG. 5. Referring now to FIG. 5, an electroplating system 100 is illustrated which employs the apparatus of the type shown in FIG. 1. A continuous strip 60 of punched out lead frames 61 as in FIG. 4 is utilized. The lead frame 61 is periodically repeated in the strip 60 which is arranged for movement by means of a stepping motor 101 which drives a conveyor 102 which supports the lead frame strip 60. The nozzle head assembly 10 is provided with a plurality of jet forming nozzles 12' arranged in such a manner that each nozzle 12' will direct the plating solution over a particular contact area 63 or 64 of the lead frame 61 to be plated. In other words each of the nozzles 12 is arranged over an end portion 63 or 64 of a lead 62 and in opposition thereto so as to deposit a spot in accordance with the size of the nozzle opening 14 on the respective end portion 63 or 64 of the lead. The stepping motor 101 or other motive means is adapted to sequentially advance the lead frame strip 60 to appropriately position under the nozzle head assembly 10 a lead frame. A suitable sensing device 103 is provided for sensing when the stepping motor 101 has advanced a lead frame under the nozzle head assembly 10. The sensing device 103 may be of any conventional design such as a light sensor sensing notches 67 in the strip 60. Upon sensing the position of the lead frame 61 the sensing device 103 is designed to activate the power source 104 so as to apply a voltage across the anode 12 and cathode 20 for a predetermined time so as to selectively spot plate the lead frame. Upon sensing the de-energization of the power source 104, sensing means 105 activates stepping motor 101 to stepwise advance the next lead frame 61 under the nozzle assembly 10 and the process is repeated. A suitable form of sensing and advancing means which may be employed in combination with the electrodepositing system of the present invention is disclosed in U.S. Pat. No. 3,957,614.

While the process and apparatus of the present invention have been described and exemplified with reference to the field of microelectronics, it will be appreciated that much broader applications can be made.

mm is an abreviation for millimeters.

mls is an abbreviation for milliliters.

The electrolyte used to plate the metal spot in accordance with this invention may have any desired composition as are well-known in the art. The apparatus of this invention is adapted to utilize electrolytes which require consumable or non-consumable electrodes. The metal which is plated may be any desired metal or other material. Preferably, the plated metal is one having a high electrical conductivity such as gold, silver, or copper.

The U.S. patents set forth in this application are intended to be incorporated by reference herein.

It is apparent that there has been provided in accordance with this invention a process and apparatus which fully satisfy the objects, means, and advantages set forth hereinbefore. While the invention has been described in combination with specific embodiments thereof, it is evident that many alternatives, modifications, and variation will be apparent to those skilled in the art in light of the foregoing description. Accordingly, it is intended to embrace all such alternatives, modifications, and variations as fall within the spirit and broad scope of the appended claims.

I claim:

1. An apparatus for selectively electroplating at least one spot of metal on a substrate, said apparatus comprising:

means for electroplating said spot of metal on said substrate, said electroplating means comprising:

an anode;

means for forming an unmasked flowing column of electrolyte having no substantial fanning out and a transverse cross-section substantially corresponding to the shape of said spot extending between said anode and said substrate, said column of electrolyte having a width from about 0.25 millimeters to about 5 millimeters and a flow rate of about 0.5 milliliters per second to about 1.0 milliliters per second;

said unmasked column forming means comprising a tubular nozzle having a nozzle outlet opening spaced from said substrate;

means for supplying by gravity said electrolyte to said column forming means at a hydrostatic head pressure in the range of about 1 to 3 psi;

means for connecting said substrate as a cathode; and means for applying a current to said anode and said cathode for depositing said spot of metal on said substrate whereby said spot has a dimension substantially approximating the size of said nozzle opening.

2. An apparatus as in claim 1 wherein said tubular nozzle also comprises said anode.

3. An apparatus as in claim 2 wherein said tubular nozzle comprises a metallic tubular member.

4. An apparatus as in claim 1 wherein said anode is located generally centrally of said tubular nozzle.

5. An apparatus as in claim 1 wherein said supply means includes an adjustable hydrostatic head pressure.

6. An apparatus as in claim 1 wherein said substrate comprises a strip of metal and further including means for sequentially advancing said strip of metal under said column forming means to form sequentially a plurality of said deposited spots of metal.

7. An apparatus as in claim 1 further including a plurality of unmasked column forming means communicating with said supply means, said plurality of column forming means being spaced apart one from the other in a desired arrangement.

8. An apparatus as in claim 1 further including means for recirculating spent electrolyte to said supply means.

9. An apparatus as in claim 7 wherein said substrate comprises a strip of metal and further including means for sequentially advancing said strip of metal under said column forming means to form sequentially a plurality of said deposited spots of metal.

10. A process for selectively electroplating at least one spot of metal on a substrate, said process comprising:

electroplating said spot of metal on said substrate, said electroplating step comprising:

providing an anode;

forming an unmasked flowing column of electrolyte having no substantial fanning out and a transverse cross-section substantially corresponding to the shape of said spot extending between said anode and said substrate and having a width from about 0.25 millimeters to about 5 millimeters and a flow rate of about 0.5 milliliters per second to about 1.0 milliliters per second;

said step of forming said unmasked flowing column of electrolyte comprising providing a tubular nozzle having a nozzle outlet opening and spacing said opening from said substrate;

supplying by gravity said electrolyte for forming said column at a hydrostatic head pressure in the range of about 1 to 3 psi;

connecting said substrate as a cathode; and applying a current to said anode and said cathode for depositing said spot of metal on said substrate so that said spot has a dimension substantially approximating the size of said nozzle opening.

11. A process as in claim 10 further including adjusting said hydrostatic head pressure.

12. A process as in claim 10 wherein said substrate comprises a strip of metal and further including the steps of sequentially advancing said strip of metal under said column of electrolyte to form sequentially a plurality of said deposited spots of metal.

13. A process as in claim 10 wherein said electroplating step comprises electroplating a plurality of spots of metal on said substrate simultaneously by forming a plurality of said flowing columns of electrolyte.

14. A process as in claim 10 further including recirculating spent electrolyte to a supply means.

15. The apparatus of claim 1 wherein:

said electroplating means further comprises means for minimizing the amount of unnecessary plating; and said anode comprises an unmasked anode.

16. The process of claim 10 wherein:

said electroplating step further comprises minimizing the amount of unnecessary plating; and said step of providing an anode comprises providing an unmasked anode.

* * * * *